United States Patent [19]

Otani et al.

[11] 4,397,817

[45] Aug. 9, 1983

[54] CATALYTIC CONVERTER

[75] Inventors: Junji Otani, Ohmiya; Yasuo Ikenoya, Kawagoe; Kanau Iwashita, Sakato; Kazuo Fujiwara, Hatoyama, all of Japan

[73] Assignee: Honda Giken Kogyo Kabushiki Kaisha, Tokyo, Japan

[21] Appl. No.: 294,798

[22] Filed: Aug. 20, 1981

[30] Foreign Application Priority Data

Aug. 20, 1980 [JP] Japan ..... 55-117717[U]
Aug. 22, 1980 [JP] Japan ..... 55-119627[U]

[51] Int. Cl.[3] ..... F01N 3/28
[52] U.S. Cl. ..... 422/179; 422/221
[58] Field of Search ..... 422/179, 180, 221, 222; 60/299, 301; 138/108, 112; 55/502; 165/81, 82

[56] References Cited

U.S. PATENT DOCUMENTS

| | | | |
|---|---|---|---|
| 3,947,252 | 3/1976 | Museall et al. | 422/179 |
| 3,948,611 | 4/1976 | Stawsky | 422/179 |
| 4,142,864 | 3/1979 | Rosynsky et al. | 422/180 |
| 4,163,042 | 7/1979 | Lynch | 422/179 |
| 4,279,864 | 7/1981 | Nara et al. | 422/180 |
| 4,335,077 | 6/1982 | Santiago et al. | 422/179 |

FOREIGN PATENT DOCUMENTS

| | | | |
|---|---|---|---|
| 2412863 | 10/1974 | Fed. Rep. of Germany | 422/179 |
| 54-102414 | 8/1979 | Japan | 422/180 |
| 55-64111 | 5/1980 | Japan | 422/180 |
| 562396 | 5/1975 | Switzerland | 422/179 |

*Primary Examiner*—David L. Lacey
*Attorney, Agent, or Firm*—Armstrong, Nikaido, Marmelstein & Kubovcik

[57] ABSTRACT

A catalytic converter effective to prevent damage or breakage of a catalytic element for improved durability. A catalytic element is housed in a casing and a pair of first and second end members are fitted into the opposite end portions of the casing so as to support the opposite end portions of the catalytic element via first and second end cushions. The first and second end cushions have, when in a free state, a rectangular cross section and inner diameters gradually increasing toward the catalytic element. The first and second cushions are compressed, when the catalytic converter is assembled, by the first and second end members to be fitted and held at their respective inner end portions between the inner circumferential surface of the casing and the outer circumferential surfaces of opposite end portions of the catalytic element.

7 Claims, 7 Drawing Figures

CATALYTIC CONVERTER

BACKGROUND OF THE INVENTION

1. Field of the Invention

This invention relates to a catalytic converter used with an exhaust system for an internal combustion engine and, more particularly, to end cushions for such a catalytic converter.

2. Description of the Prior Art

There is a known method of cleaning an exhaust gas from an internal combustion engine installed in a vehicle or the like, in which method noxious components of the exhaust gas, such as HC and CO, are converted into $CO_2$ and $H_2O$ in the presence of $O_2$ by utilizing a catalytic converter arranged in an exhaust system, to thereby clean the exhaust gas. A ceramic honeycomb coated with a catalytic metal has come to be used as a catalytic element in recent years because of its low resistance to the flow of exhaust gas, compact size and light weight. It is necessary that a ceramic honeycomb, which is far more fragile than a metal, be inserted with a special care into a casing which is connected in an exhaust system. It is desirable that such a catalytic element be supported in a shock absorbing manner in a casing so as to prevent its relative movement and allow it to display its performance to a full extent.

SUMMARY OF THE INVENTION

An object of the present invention is to provide a catalytic converter, in which a catalytic element is supported in a casing in a shock absorbing manner so as to prevent damage or breakage of the catalytic element for improved durability even when the casing is vibrated or otherwise moved.

Another object of the present invention is to provide an economical catalytic converter employing end cushions which are adapted to support a catalytic element in a shock absorbing manner without reducing the effective cross-sectional area of the catalytic element for cleaning of exhaust gas to thereby maintain its excellent cleaning performance for a long period of time.

A further object of the present invention is to increase the durability of a catalytic element by employing end cushions which are not presented in a passage for a high-temperature exhaust gas to avoid its exposure to the heated exhaust gas to thereby effectively prevent burning out or other undesirable effects of the end cushions and hence resulting damage or breakage of the catalytic element.

According to the present invention, there is provided a catalytic converter comprising a casing, a catalytic element housed in the casing, and first and second end members fitted into opposite end portions of the casing and supporting the opposite end portions of the catalytic element via first and second end cushions, the first and second end cushions having, when in a free state, a rectangular cross section and inner diameters gradually increasing toward the catalytic element, the first and second end cushions being compressed, when the catalytic converter is assembled, by the first and second end members to be fitted and held at their respective inner end portions between the inner circumferential surface of the casing and the outer circumferential surfaces of the opposite end portions of the catalytic element.

The above and other objects as well as advantageous features of the invention will become apparent from the following description of the preferred embodiments taken in conjunction with the accompanying drawings.

BRIEF DESCRIPTION OF THE DRAWINGS

FIGS. 1–3 show a first embodiment of the present invention, wherein:

FIG. 1 is a longitudinal sectional view of a catalytic converter in a non-assembled state using a pair of novel form of end cushions according to the present invention;

FIG. 2 is a longitudinal sectional view of the catalytic converter in an assembled state;

and FIG. 3 is a graph showing the relation between an amount of insertion of an end cushion and a bulk density thereof.

FIGS. 5–7 shows a third embodiment of the present invention, wherein:

FIG. 5 is a longitudinal sectional view of a catalytic converter in a non-assembled state using a pair of further modified form of end cushions;

FIG. 6 is a longitudinal sectional view of the catalytic converter in an assembled state;

and FIG. 7 is a cross-sectional view of the end cushions.

DESCRIPTION OF THE PREFERRED EMBODIMENTS

Figure 1:
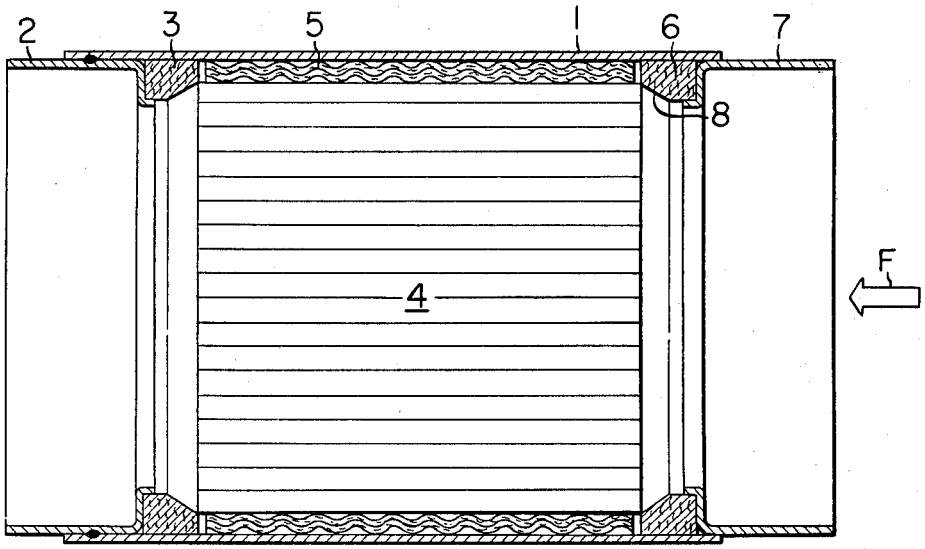

In the following description of the preferred embodiments, the same parts of different embodiments will be identified with the same reference numerals.

Figure 2:
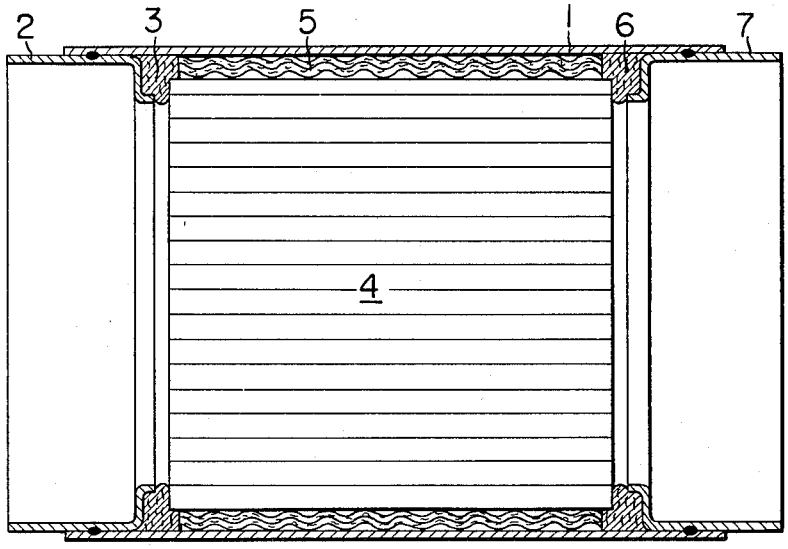

A first embodiment of the present invention will be described with reference to FIGS. 1 and 2. A first short tubular end member 2 is inserted into and fixedly secured by spot welding to one end portion of a tubular metal casing 1 into which are inserted a first annular end cushion 3, a catalytic element 4 having a circumferential cushion 5 attached to the outer circumferential surface thereof, and a second annular end cushion 6 in this order. Finally, a second short tubular end member 7 is fitted into the casing 1 by applying an axial load F thereto to compress the pair of end cushions 3, 6. The second end member 7 is fixedly secured by spot welding to the other end portion of the casing to provide an assembled catalytic converter as shown in FIG. 2.

The catalytic element 4 comprises a ceramic honeycomb coated with a catalytic metal. The circumferential cushion 5 comprises stainless steel wires of 0.15–0.25 mm in diameter, which are knitted like stockinet, waved by a corrugated roller and formed into a tubular shape.

The paired annular end cushions 3, 6 are also formed of stainless steel wires of 0.15–0.25 mm in diameter, which are knitted into a tubular form. The paired end cushions 3, 6 are required to support opposite end portions of the catalytic element 4 with a predetermined force in a shock absorbing or attenuating manner so as to impart a predetermined frictional force to the catalytic element to prevent its rotary, axial sliding or other relative movements occurring upon vibrations or other violent motions of the casing 1 while ensuring the excellent cleaning performance of the catalytic element for a long period of time without causing the fragile catalytic element to be damaged or broken. In order to meet such requirements, the end cushions 3, 6 are formed so as to have a shape and a bulk density as will be described hereinafter. The end cushions 3, 6 in a free state before fitting into the casing 1 have a substantially rectangular cross section, as shown in FIG. 1; a bulk density of 0.38–0.76 g/cm$^3$, which is 5–10% of a solid density of steel wires, such as stainless steel wires, constituting the cushions 3, 6; and inner diameters gradually increasing toward the catalytic element 4. The end cushions 3, 6 are axially compressed, after they have been fitted into the casing, to have an L-shaped cross section. When the end cushions 3, 6, the bulk density of which is set at the above-mentioned level, are inserted into the casing 1, the inner ends of the outer circumferential portions of the end cushions 3, 6 are fitted into annular spaces formed between the inner circumferential surface of the casing 1 and the outer circumferential portion of the catalytic element 4 to thereby cover the corner portions of the catalytic element 4, imparting a predetermined frictional force thereto so as to prevent rotary or sliding movements of the catalytic element 4. In this case, the inserted amount l of the end cushions is preferably not less than 2 mm. Since the inner diameters of the end cushions 3, 6 increase gradually toward the catalytic element 4, the inner circumferential portions thereof under compression are not projected inwardly beyond the inner circumferential edges of the end members 2, 7.

Figure 3:
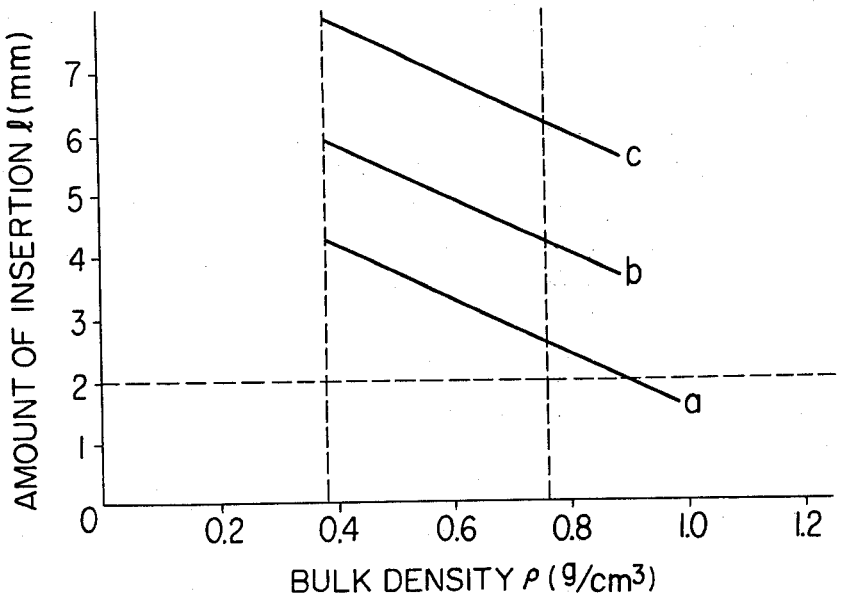

FIG. 3 graphically shows the relation between a bulk density $\rho$(g/cm$^3$) of the end cushions 3, 6 in a free state and an amount of insertion (mm) of the same when subjected to compression. In this graph, lines a, b, c indicate the relations between an amount of insertion l(mm) of each of the end cushions 3, 6 and a bulk density $\rho$(g/cm$^3$) thereof measured in a free or non-compressed state, with an initial thickness of each of the end cushions being 6 mm, 9.5 mm, and 9.5 mm respectively, and a pressing load applied thereto upon the assembling operation being 250 Kg, 250 Kg and 500 Kg, respectively. In all of these cases, the amounts of insertion l are not less than 2 mm, and the end cushions 3, 6 serve to impart a sufficient frictional retaining force to the catalytic element 4 to prevent the rotation and sliding movement of the catalytic element 4 due to vibrations transmitted thereto, thus improving the durability of the catalytic element 4 as well as giving rise to excellent holding thereof.

Figure 4:
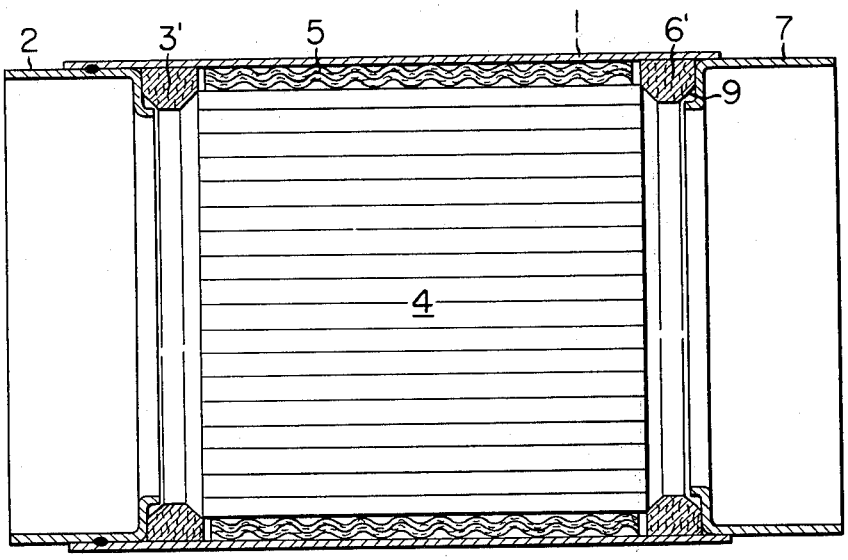
FIG. 4 is a longitudinal sectional view of a second embodiment of the present invention in a non-assembled state using a pair of modified form of end cushions.
Figure 5:
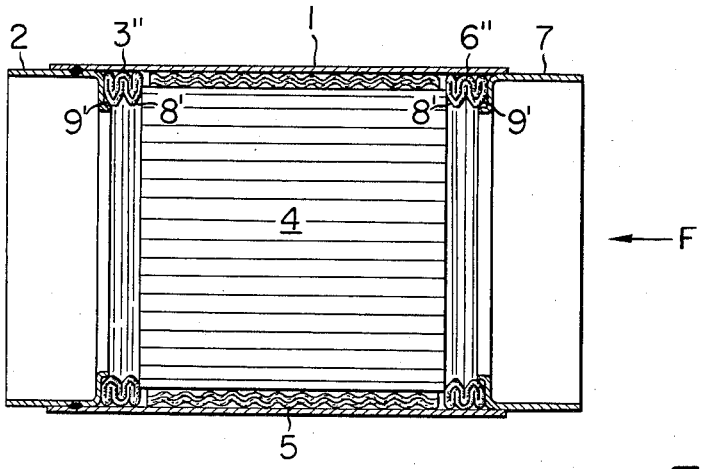
Figure 6:
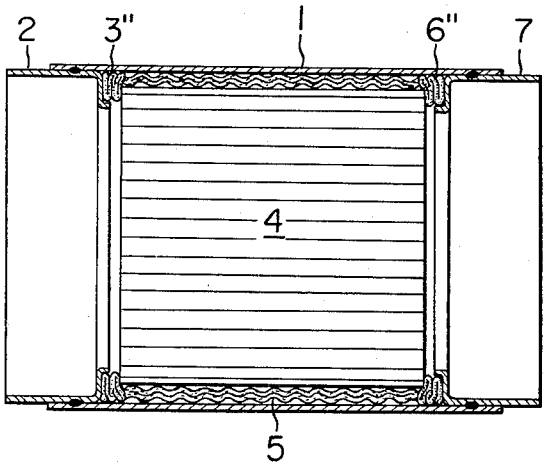
Figure 7:
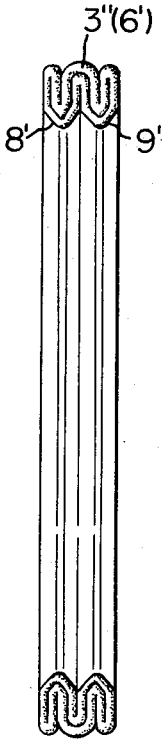

FIG. 4 shows a second embodiment of the present invention. This embodiment employs end cushions 3', 6', the inner diameters of which gradually increase in opposite directions, namely toward and away from the catalytic element 4. Except for the above-mentioned feature, these end cushions 3', 6' are identical in construction and operation with the end cushions employed in the first embodiment. FIGS. 5–7 show a third embodiment of the present invention. End cushions 3'', 6'' employed in this embodiment is formed by knitting stainless steel wires of 0.15–0.25 mm in diameter into a tubular shape, flattening the knitted products, and bending the resulting products in the radial direction and in a staggered or zigzag manner. The end cushions 3'', 6'' in a free or non-compressed state have a substantially rectangular cross section, as shown in FIGS. 5 and 7. Each of the end cushions 3'', 6'' has outwardly-diverging tapered sections 8', 9' at opposite sides of the inner circumferential surface thereof. When the end cushions 3'', 6'' are fitted into a casing 1, they are compressed axially to force the inner ends of the outer circumferential portions thereof into spaces between the inner circumferential surface of the casing 1 and the outer circumferential surface of a catalytic element 4, so that corner portions of the catalytic element 4 are thereby firmly held with a predetermined level of clamping force. The end cushions 3'', 6'' are also designed so as to have a bulk density of 0.38–0.76 g/cm$^3$ (5–10% of a solid density of the stainless steel wires) when they are in a free state. An inserted amount of each of the end cushions 3'', 6'', after being compressed, is not less than 2 mm.

The flattened cushion elements constituting the ring type end cushions 3'', 6'' are bent radially in a staggered or zigzag manner. Therefore, even when the end cushions 3'', 6'' are compressed axially so as to be fitted into the casing, the end cushions 3'', 6'' are neither expanded radially, nor are they projected inwardly from the inner ends of the inner circumferential surfaces of the end members 2, 7.

According to the present invention described above, the first and second annular end cushions 3, 6 supporting the catalytic element 4 at opposite ends thereof are formed such that the end cushions 3, 6 have a rectangular cross section when they are in a free state, and an inner diameter increasing gradually toward the catalytic element 4. Accordingly, after the catalytic converter has been assembled, the inner ends of the outer circumferential portions of the first and second end cushions 3, 6 are fitted in a compressed state between the inner circumferential surface of the casing 1 and the outer circumferential portions of the catalytic element 4. As a result, a predetermined frictional force is imparted to the catalytic element 4 to prevent its relative movements so that the catalytic element can be protected from damage or breakage. This allows the life of the catalytic element to be prolonged.

Since the first and second end cushions 3, 6 have the above-mentioned special cross-sectional shape in their free or non-compressed state, they are not projected inwardly from the inner circumferential surfaces of the first and second end members 2, 7 after the end cushions 3, 6 have been compressed. Accordingly, the effective diameter of the catalytic element 4 is not reduced, nor is the cleaning capability of the catalytic element lowered. Moreover, the end cushions are not presented into a passage through which a high-temperature exhaust gas flows, so that the end cushions are not burnt off, thus preventing the resulting damage or breakage of the catalytic element 4.

Since the first and second end cushions 3, 6 in a non-compressed state have a simple shape, they can be manufactured at a low cost.

While the invention has been particularly shown and described with reference to preferred embodiments thereof, it will be understood by those skilled in the art that the foregoing and other changes in form and details can be made therein without departing from the spirit and scope of the appended claims.

What is claimed is:

1. A catalytic convertor comprising a casing having opposite end portions and an inner circumferential surface, a catalytic element housed in said casing and having opposite end portions with outer circumferential surfaces, first and second end cushions adjacent said opposite end portions of said catalytic element having inner end portions, and first and second end members fitted into said opposite end portions of said casing and supporting said opposite end portions of said catalytic element via said first and second end cushions, said first and second end cushions being constructed such that in a free state each has a rectangular cross section and inner diameters which gradually increases toward said catalytic element, said first and second end cushions being compressively fitted between said first and second end members and said opposite end portions of said catalytic element and said respective inner end portions of said first and second end cushions being held between the inner circumferential surface of said casing and the outer circumferential surfaces of the opposite end portions of said catalytic element.

2. A catalytic converter according to claim 1, wherein each of said end cushions is formed of heat resisting steel wires which are knitted into an annular body having said substantially rectangular cross section, the bulk density of said annular body in a free state being set to be at 5–10% of a solid density of said steel wires.

3. A catalytic converter according to claim 1, wherein each of said end cushions comprises knitted heat resisting steel wires which have been flattened and bent in a radial direction such that each end cushion has a zigzag shape.

4. A catalytic converter according to claim 1, further comprising a circumferential cushion disposed between said casing and said catalytic element.

5. A catalytic converter according to claim 4, wherein said circumferential cushion comprises a corrugated tubular body comprising knitted heat resisting steel wires.

6. A catalytic converter according to claim 2, 3 or 5, wherein said heat resisting steel wires comprise stainless steel.

7. A catalytic converter according to claim 1, wherein each of said end members comprises a short tubular body having a stepped inner end surface.

* * * * *